United States Patent [19]

Passal

[11] 3,972,788

[45] Aug. 3, 1976

[54] ZINC ANODE BENEFACTION

[75] Inventor: Frank Passal, Detroit, Mich.

[73] Assignee: M & T Chemicals Inc., Greenwich, Conn.

[22] Filed: Jan. 6, 1975

[21] Appl. No.: 538,603

[52] U.S. Cl. ..... 204/55 R

[51] Int. Cl.[2] ..... C25D 3/22

[58] Field of Search ..... 204/55 R, 43 Z, 44, 204/114

[56] References Cited

UNITED STATES PATENTS

| | | | |
|---|---|---|---|
| 3,778,358 | 12/1973 | Holker | 204/55 R |
| 3,822,194 | 7/1974 | Rushmere | 204/55 R |

FOREIGN PATENTS OR APPLICATIONS

| | | | |
|---|---|---|---|
| 794,826 | 9/1968 | Canada | 204/55 R |

*Primary Examiner*—G. L. Kaplan
*Attorney, Agent, or Firm*—Kenneth G. Wheeless; Robert P. Auber; Robert Spector

[57] ABSTRACT

This invention relates to an improved method of electroplating zinc while simultaneously effecting enhanced anode corrosion characteristics, which comprises passing current from a zinc anode to a metal cathode through a plating solution containing at least one organic brightener, a chloride-containing salt providing chloride anions and boric acid as a buffer in the absence of ammonium cations, chelating agents, and complexing agents for a time period sufficient to deposit a zinc electrodeposit upon said cathode; the improvement consisting of the current passing through an aqueous acidic bath composition containing zinc sulfamate providing zinc cations for electroplating zinc.

2 Claims, No Drawings

ZINC ANODE BENEFACTION

BRIEF DESCRIPTION

This invention relates to the electrodeposition of zinc, and is specifically useful for effecting enhanced anode corrosion characteristics. More particularly this invention relates to improved zinc plating bath compositions, to methods of using and preparing such bath compositions and to improve anode effectiveness.

This invention relates to a method of producing zinc electrodeposits with zinc anode benefaction, which comprises passing current from a zinc anode to a metal cathode through a plating solution containing at least one organic brightener, a chloride-containing salt providing chloride anions and boric acid as a buffer in the absence of ammonium cations, chelating agents, and complexing agents for a time period sufficient to deposit a zinc electrodeposit upon said cathode; the improvement being the current passing through an aqueous acidic bath composition containing zinc sulfamate providing zinc cations for electroplating zinc.

This invention is predicated upon the discovery that in replacing Zinc Sulfamate for Zinc Sulfate or Zinc Chloride, not only were excellent cathode deposit characteristics retained but the anode performance was dramatically improved. It is not clear why sulfamate should be much superior to the sulfate and chloride anions in this respect since one would not normally consider sulfamate as a complexing, chelating or anode-solubilizing anion. The explanation may be that zinc sulfamate may be considerably more soluble than the sulfate or chloride salts or may prevent or inhibit formation thereby of basic zinc salt anode incrustations. Zinc Oxide and Sulfamic Acid are used to interact in water in a mole ratio of 1 to 2 respectively to form Zinc Sulfamate.

$$ZnO + 2NH_2SO_3H \rightarrow Zn(O_3SNH_2) + H_2O$$

Using zinc sulfamate to provide both excellent anode and cathode plating characteristics results in a unique system with outstanding advantages over existing processes. The improved process is of particular advantage for rack plating applications where suspended matter is of more concern than for barrel plating purposes.

The zinc sulfamate may be introduced by interaction of zinc oxide and sulfamic acid in the preparation of the plating bath or may be used as a liquid concentrate to be used by suitable dilution to a desired working concentration and the addition of other bath ingredients such as NaCl, $H_3BO_3$ and organic-type additives. A concentrate may be prepared which in use would involve diluting 1 part by volume with 3 parts by volume of water.

DETAILED DESCRIPTION

This invention relates to an improved method of electroplating zinc while simultaneously effecting enhanced anode corrosion characteristics, which comprises passing current from a zinc anode to a metal cathode through a plating solution containing at least one organic brightener, a chloride-containing salt providing chloride anions and boric acid as a buffer in the absence of ammonium cations, chelating agents, and complexing agents for a time period sufficient to deposit a zinc electrodeposit upon said cathode; the improvement consisting of the current passing through an aqueous acidic bath composition containing zinc sulfamate providing zinc cations for electroplating zinc.

Bath compositions which have given excellent results both in Hull Cell and 4-liter life tests have been the following:

| | Range |
|---|---|
| Zinc Sulfamate | 100 – 200 g/l |
| Sodium Chloride | 25 – 40 g/l |
| Boric Acid | 20 – 35 g/l |

The zinc plating bath may be prepared using zinc sulfamate as the source of zinc; additional chloride anion for purposes of increasing conductivity and promoting good anode corrosion may be salts such as sodium chloride, potassium chloride, aluminum chloride, magnesium chloride, calcium chloride, etc. i.e. chloride salts the cations of which are bath and process compatible and which do not include as cations ammonium or amine moieties. Boric Acid is advantageous as a pH buffer. The addition of organic additives is necessary for bright zinc electrodeposits.

The operating temperatures of the baths are ambient temperatures ranging, say, from 15° to 40°C. Agitation is preferably of the moving cathode rod type or even involving the use of air, the latter if the polyether surfactant permits it by being of low foaming type.

Anodes generally consist of 99.99+ pure zinc which may be immersed in the plating bath in baskets made of an inert metal such as titanium or which may be suspended in the bath by hooks hanging on the anode bar made of an inert metal such as titanium.

The plating baths may be used for rack or barrel plating purposes. The basis metals generally plated are ferrous metals such as steel or cast iron to be zinc plated for protection against rusting by a cathodic protection mechanism and also for providing decorative eye appeal. To further enhance the protective action of the zinc, the zinc, after plating, may be subjected to a conversion coating treatment, generally by immersion or anodic electrolytic action in baths containing hexavalent chromium, catalysts, accelerators, etc. The conversion coating treatment may enhance the luster of the zinc as plated by a chemical or electropolishing action as well as providing a conversion coating film consisting of a mixture of Cr VI, Cr III and Zn compounds ranging in color from very light iridescent, to blue, to iridescent yellow to olive drab etc. The more highly colored coatings are thicker and may provide better corrosion protection in humid, saline atmospheres. To further enhance protective action, usually on the more transparent, lighter colored films, there may be applied lacquer coatings, air dried or baked. To some of the thinner, lighter-colored conversion coating there may be applied a more intense and varied color by immersion in solutions of suitable dyestuffs to give pure jet black to pastel range of colors which may then be followed by lacquer coatings to apply protection against abrasion, finger staining etc. in use.

Although the concentration of salts in preparing plating baths is not too critical there are certain concentrations not to be exceeded, which can only be determined by actual experimentation, otherwise some of the optional organic additives, particularly sulfonated castor oil, may salt or oil out resulting in deleterious effects on appearance, uniformity, continuity etc. of the zinc deposits as well as on their luster and nature of grain refinement. Similarly the actual and relative salt concentrations must be so chosen, again based on experimentation, to provide maximum deposit ductility and adhesion and a minimum of tensile stress in order to avoid spontaneous peeling, exfoliation or spalling of deposits after plating and in use applications. Because of these factors wide limits of concentration of individual bath ingredients cannot be given as well as relative concentrations of several basic bath ingredients. Some general criteria of basic bath formulation, based on extensive bath formulation observations, are that very high zinc and chloride contents should be avoided since they may adversely affect compatability with organic additives and physical properties of deposits.

The operating pH of the baths when properly formulated is not critical and may range, say, from about 2.5 to about 5.5 with a preferred range of about 3.5 to 4.5.

Cathode current densities may range from about 0.1 to 5.0 amperes per square decimeter (ASD) depending on whether the plating is done in barrels or on racks and on such factors as concentration of bath zinc metal, conducting salts, buffers etc. and on the degree of cathode agitation. Anode current densities also may range from about 0.5 to 3.0 ASD depending on bath ingredient concentrations, degree of solution circulation around the anodes etc.

The bath cations preferably consist of Zn and Na, bath anions are preferably $Cl^{-1}$ or $NH_2SO_3^{-1}$ and may consist of combinations thereof. Certain anions such as acetate have been found to have a very definite harmful effect on bath performance for reasons which are not well understood. Such deleterious effects may be non-uniformity of deposit luster and formation of off-color yellowish to brownish yellow colors and excessive graininess of deposit which normally cannot be counteracted by subsequent conversion coating treatment.

Organic brighteners operable in the practice of this invention include sulfonated castor oil, polyether surfactants, and aromatic carbonyl compounds.

For addition to the zinc electroplating bath the sulfonated castor oil is used in the form of an aqueous stock solution, in which it is highly soluble, or may be admixed with an aqueous stock solution of the polyether surfactant which in addition may contain grain-refining or brightening agents.

The polyether surfactant may be completely nonionic or may have also, in addition to polyether groups, anionic or cationic or mixed anionic-cationic moieties. Preferred compounds are the following:

(a) $H_3C-(CH_2)_n-COO(CH_2\underset{\underset{R}{|}}{C}HO)_x-H$ where
$n = 10 - 20$
$R = H$ or $CH_3$ (b) $R-(CH_2\underset{\underset{R'}{|}}{C}HO)_x(CH_2CH_2O)_yH$ where
$R' =$ methyl ($CH_3$)
$R =$ alkyl straight or branched chain containing 10 – 18 (atoms)
$X = 2$ to 5
$Y = 10$ to 20

(c) $HO(CH_2\underset{\underset{R}{|}}{C}HO)_xH$ where
$R = H$ or $CH_3$
$X =$ an integer to give a Molecular Weight of 300 to 1000

(d) 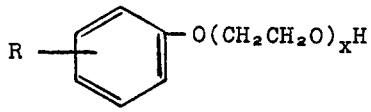

where
$R =$ straight C chain having 9 – 18 atoms of C
$X = 10 - 20$

Preferred concentration limits of the polyether surfactants, which may be used singly or in combination, are about 1 to 30 grams per liter.

Typical aromatic carbonyl compounds which are effective in the practice of this invention are the following.

(a) 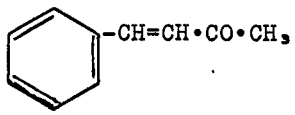 Benzylidene Acetone (or Benzalacetone)

(b) 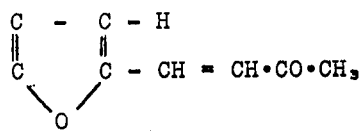 Furfuryl Acetone (c) 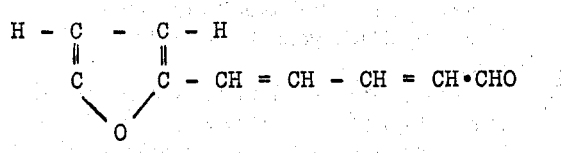

Furfuryl Crotonaldehyde (d) 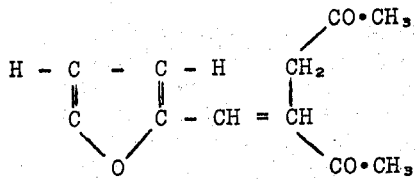

Furfuryl Acetonylacetone

Preferred concentration limits of aromatic carbonyl compounds operable in the practice of this invention are about 0.025 to 1 gram per liter.

The plating baths are relatively tolerant to metallic impurities such as iron which are liable to be introduced and many such as iron form basic salt precipitates which can be filtered out thus making the bath self purging with respect to such impurities.

The following examples are submitted for the purpose of illustration only and are not to be construed as limiting the scope of the invention in any way.

Hull Cell tests were run under conditions described as follows and the deposits were examined along a line 2.54 cm from and parallel to the bottom edge of the Hull Cell panel.

A polished brass panel was scribed with a horizontal single pass of 4/0 grit emery to give a band width of about 1 cm at a distance of about 2.5 cm from the bottom of the panel. After cleaning the panel, including the use of a thin cyanide copper strike to assure excellent physical and chemical cleanliness, it was plated in a 267 ml. Hull Cell, at a 1 ampere cell current for 5 minutes, at a temperature of 20°C. using magnetic stirring, and a 99.99+ pure zinc sheet as an anode.

EXAMPLE 1

A Hull Cell panel was run on a bath having the composition after adjusting the pH to 4.0:

| | |
|---|---|
| $Zn(O_3SNH_2)_2$ | 144 g/l |
| Na Cl | 30 g/l |
| Boric Acid | 25 g/l |
| Polyether Surfactant - $CH_3(CH_2)_2(CH_2\overset{CH_3}{\overset{\vert}{C}}HO)_3(CH_2CH_2O)_{15}H$ | 10 g/l |
| Benzalacetone | 0.2 g/l |

The deposit was fairly fine grained but excessively milky and somewhat non-uniform.

On adding 0.44 g/l of sulfonated castor oil and repeating the Hull Cell test a brilliant deposit with fairly good low current density coverage was obtained throughout the entire current density range (about 0 to 6 ASD).

EXAMPLE 2

The bath of Example 1 was then subjected to a 4-liter life test using conditions as follows:

Plating cell — 5 liter rectangular cross-section (13 cm × 15 cm) made of Pyrex.
Solution volume — 4 liters to give a solution depth, in absence of anode, of about 20.5 cm.
Temperature — 20°C. (maintained by immersing cell in a thermostatically controlled water bath).
Agitation — moving cathode bar.
Anode — 99.99+ zinc balls, 5 cm in diameter strung on titanium wire — 5 balls per cell.
Cathode — brass strip (2.54 cm × 20.3 cm × 0.071 cm) buffed and polished on one side and immersed to a depth of about 17.8 cm — horizontal bend 2.54 cm from bottom and the next 2.54 cm bent to give an internal angle on the polished side of cathode of about 45° — polished side facing anode at an approximate distance of 10.2 cm and scribed vertically in center with a 1 cm wide band of a single pass of 4/0 grit emery paper scratches.
Cell current — 2.0 amperes.
Time — 10 minutes to 8 hours per day.
Filtration — occasional batch.

The 4-liter life test was run for a total of 450 ampere-hours of electrolysis. Some deposits were plated for 10 to 15 minutes to give normally utilized thicknesses of zinc (0.2 to 0.5 mils or 5.1 to 12.7 microns) while other deposits were plated for as long as 7 to 8 hours to observe physical properties such as ductility, tensile stress etc. and to provide sufficient electrolysis to deplete some of the organic additives. Uniformly highly lustrous, compressively stressed, relatively ductile, nonexfoliated or cracked, deposits were consistently obtained which did not tarnish after plating or after conversion coating treatment. The additive consumed and replenished was Benzalacetone, which, after the bath had stabilized was consumed at an approximate rate of about 0.2 gram per 15 ampere-hours. The deposits exhibited good leveling characteristics.

EXAMPLE 3

Comparison 4-liter comparative life tests were run for a total of about 250 ampere-hours on each of the baths listed below as (a), (b) and (c):

| | | |
|---|---|---|
| (a) | $ZnSO_4.7H_2O$ | 160 g/l |
| | NaCl | 30 g/l |
| | $H_3BO_3$ | 25 g/l |
| (b) | $ZnCl_2$ | 75 g/l |
| | $H_3BO_3$ | 25 g/l |
| (c) | $Zn(O_3SNH_2)_2$ | 144 g/l |
| | NaCl | 30 g/l |

-continued

| | |
|---|---|
| Boric Acid | 25 g/l |

To each of the foregoing there was added the same surfactant concentration as for Example 1 and the same concentration of Benzalacetone and sulfonated castor oil and the pH was adjusted to 4.0.

The life test plating results were essentially the same however the anode corrosion characteristics with respect to the absence of salt (etc.) incrustations were much superior for bath (c), the bath of this invention, resulting in much less suspended matter and a cleaner electrolyte.

EXAMPLE 4

Preparation of Sulfamate Zinc Concentrate

| | | | |
|---|---|---|---|
| $ZnO +$ | $2\ NH_2SO_3H$ | $\rightarrow$ | $Zn(SO_3NH_2)_2 + H_2O$ |
| 81.38 | (2) (97.09) | | 257.56 |

200 g. ZnO (19.2 g. excess) was suspended in 500 ml. water and while stirring magnetically added 430.8 grams Sulfamic Acid (Eastman Practical) — stirred until pH about 4.4 (Paul Frank pH papers) — treated with 3 g. activated carbon — filtered — diluted to 1 liter with water — pH 4.4 — Specific Gravity = 1.355.

Nominal Concentrations.

Zn — 146 g/l

Sulfamate — 423 g/l

When 1 part diluted with 3 parts water by volume the foregoing should give 36.4 g/l Zn and 105.7 g/l Sulfamate.

Although this invention has been illustrated by reference to specific embodiments, modifications thereof which are clearly within the scope of the invention will be apparent to those skilled in the art.

I claim:

1. An improved aqueous acidic plating solution for anode benefaction containing 100 to 200 grams per liter of zinc sulfamate providing zinc cations for electroplating zinc, 25 to 40 grams per liter of sodium chloride providing chloride anions and 20 to 35 grams per liter of boric acid as a buffer in the absence of ammonium cations, chelating agents, and complexing agents.

2. In a method of electroplating zinc while simultaneously effecting enhanced anode corrosion characteristics which comprises passing current from a zinc anode to a metal cathode through an acidic zinc electroplating bath comprising an aqueous solution of:

a. 100 to 200 grams per liter of zinc sulfamate;
b. 25 to 40 grams per liter of sodium chloride;
c. 20 to 35 grams per liter of boric acid; and
d. containing no ammonium cations, or chelating or complexing agents.

* * * * *